United States Patent [19]

Carballo et al.

[11] Patent Number: 4,726,078

[45] Date of Patent: Feb. 23, 1988

[54] TOILET VENTILATION SYSTEM

[76] Inventors: Rodolfo A. Carballo; Ermidia Carballo, both of 4648 N. Avenida De Cazador, Tucson, Ariz. 85718

[21] Appl. No.: 31,539

[22] Filed: Mar. 30, 1987

[51] Int. Cl.[4] ..... E03D 9/04; A47K 13/00

[52] U.S. Cl. ..... 4/213; 4/217; 4/347; 4/209 FF

[58] Field of Search ..... 4/209, 210, 213–218, 4/347; 98/123

[56] References Cited

U.S. PATENT DOCUMENTS

| | | | |
|---|---|---|---|
| 2,277,982 | 3/1942 | Hosbein | 98/122 |
| 2,849,727 | 9/1958 | Bollinger et al. | 4/217 |
| 3,333,285 | 8/1967 | Null | 4/217 |
| 3,689,944 | 9/1972 | Clayton | 4/213 |
| 3,740,772 | 6/1973 | Paley | 4/217 |
| 3,781,923 | 1/1974 | Maisch | 4/213 |
| 4,094,023 | 6/1978 | Smith | 4/213 |
| 4,556,999 | 12/1985 | Lindley | 4/217 |
| 4,586,201 | 5/1986 | Todd, Jr. | 4/217 |

FOREIGN PATENT DOCUMENTS

| | | | |
|---|---|---|---|
| 2145726 | 3/1972 | Fed. Rep. of Germany | 4/217 |

*Primary Examiner*—Henry K. Artis

*Attorney, Agent, or Firm*—Harry M. Weiss & Assoc.

[57] ABSTRACT

A toilet ventilation generally comprised of an inventive toilet seat, a pre-filter, a water bleed-off means, an exhaust tubular member, and an electrically powered air extraction means. The inventive toilet seat rests directly on a toilet bowl rim and contains a plurality of ducts within the toilet seat. The series of ducts guide the odorous air toward the air extraction means. A water bleed-off means is implemented to trap moisture suspended in the odorous air and to prevent the moisture from entering the exhaust tubular member and the air extraction means thereby increasing the expected life of the ventilation system.

12 Claims, 5 Drawing Figures

TOILET VENTILATION SYSTEM

BACKGROUND OF THE INVENTION

1. Field of the Invention

The present invention generally relates to an improved toilet ventilation system and, more specifically, to a toilet ventilation system, including a configured toilet seat, which efficiently and effectively allows for the unobtrusive disposition of the noxious odors commonly associated with toilet use, and has a water bleed-off means to prevent the problems associated with moisture build up within the system.

2. Description of the Prior Art

In the past, the systems which were developed for exhausting toilet bowl fumes in an attempt to alleviate the noxious odor problem were subject to a major flaw—a frequent tendency for moisture to accumulate within the enclosed areas of the system thereby fostering unhygienic conditions.

The prior art reveals numerous references. For example, Hunnicut, Jr. (U.S. Pat. No. 3,857,119) teaches a water closet ventilation system which draws air through an intake opening located adjacent to the rear portion of a toilet bowl wherein the intake opening is part of a solid fixture designed to be bolted to the toilet and situated between the rim of the bowl and the toilet seat. The Hunnicut, Jr. reference shows air filtering means either attached or connected by a hose to the intake fixture. As also conceptualized in Hunnicut, Jr., Smith (U.S. Pat. No. 3,733,619) provides a single intake opening located near the portion of the bowl which is closest to rear of the toilet Eight embodiments are presented by Paley (U.S. Pat. No. 3,740,772) in the reference Specification; all of which disclose a seat portion of a pan or sanitary system, a series of small intake openings to facilitate the flow of air into the seat, and an exhaust outlet for distribution of the odorous air to a remote location. Ables (U.S. Pat. No. 3,999,225) presents a ventilated toilet which discloses a generally hollow toilet seat that includes a plurality of small intake ports located on the under side of the toilet seat and an exhaust port, a conduit leading from the exhaust port to a wall enclosed filtration and exhaust system. Akin to Ables, Weiland (U.S. Pat. No. 4,125,906) presents a generally hollow toilet seat equipped with an exhaust port. The Weiland reference does not disclose a filtering system, but rather suggests exhausting the odorous air into the atmosphere outside of the room wherein the toilet is located. Turner (U.S. Pat. No. 4,251,888) also incorporates the use of a generally hollow toilet seat containing a series of small intake openings in the bottom side of the seat. The Turner reference discloses an electric pressure switch, also located on the bottom side of the seat, which activates a vacuum pump when weight is applied to the toilet seat. Lindley (U.S. Pat. No. 4,556,999) discloses another ventilated toilet seat. Lindley uses a plurality of inlet orifices facing the center of the space defined by the inner rim of the seat and the horizontal plane thereof.

The significant problem of moisture accumulation remains unsolved in the venting of noxious odors from toilets. The inaccessible enclosed spaces provided by prior art toilet ventilation systems are usually filled with generally stagnant, moisture and odor laden, air which fosters unappealing conditions such as mildew and bacteria accumulation, and, because moisture bleed-off means have not been provided, the unappealing conditions continue to build thereby causing the evolution of a displeasing and unhygienic environment. Accordingly, there is a distinct need for an improved toilet ventilation system which does not accumulate moisture laden air.

SUMMARY OF THE INVENTION

It is an object of this invention to provide an improved toilet ventilation system.

It is another object of this invention to provide an improved toilet ventilation system which effectively and efficiently allows for the unobtrusive disposition of the noxious odors commonly associated with toilet use.

It is a further object of this invention to provide an improved toilet ventilation system which does not act as a "target" for male users.

It is a further object of this invention to provide an improved toilet ventilation system which does not accumulate excessive moisture.

It is a still further object of this invention to provide an improved toilet ventilation system which is sturdy, simple in nature, and relatively inexpensive to manufacture.

It is still another object of this invention to provide an improved toilet ventilation system which is readily adaptable for use with conventional toilets.

DESCRIPTION OF THE PREFERRED EMBODIMENTS

Figure 1:
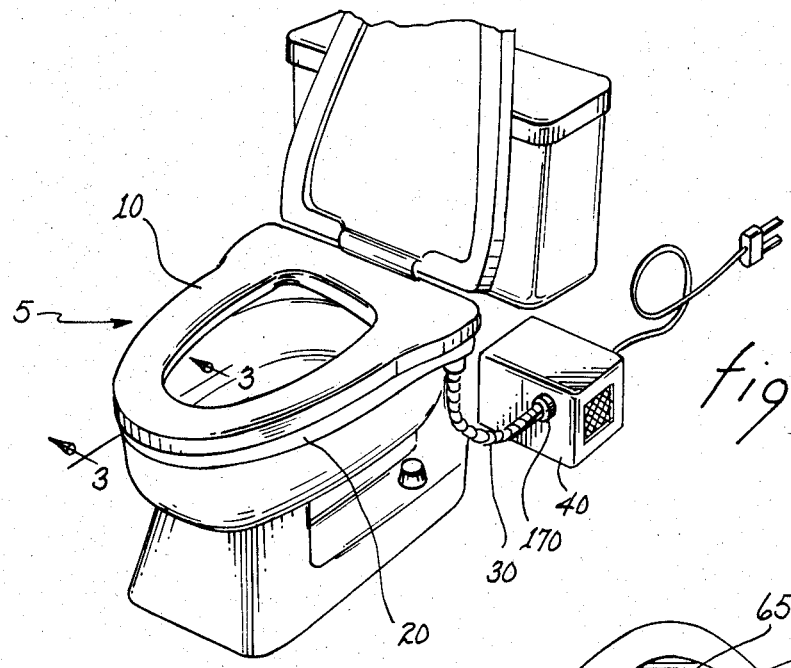
FIG. 1 is a perspective view of the toilet ventilation system of this invention operably attached to a conventional toilet bowl and water holding tank.

Referring now to FIG. 1 of the accompanying drawings which set forth the present invention in greater detail and in which like numerals designate like elements, a toilet ventilating system 5 is generally illustrated comprising a toilet seat 10, a hollow member 100 (see FIGS. 2 and 4), an exhaust tubular member 30, a detachable air extractor filter 170, and an electrically powered air extractor 40.

Figure 5:
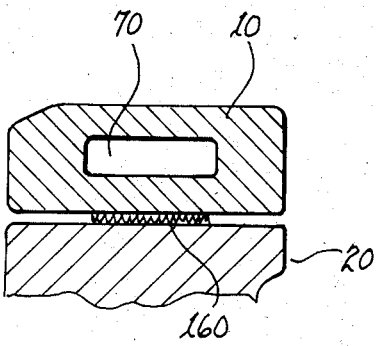
FIG. 5 is a cross sectional view taken along the line 5—5 of FIG. 2 in the direction of the arrows.

Referring also to FIG. 5 of the accompanying drawings, the toilet seat 10 is coupled to a resilient gasket means 160 which rests directly on a conventional toilet bowl rim 20, and allows for odorous air to pass from a toilet bowl area to the exhaust tubular member 30 through an inlet port 60 containing a detachable and replacable porous pre-filter element 65, a transfer duct 70, an exhaust duct 90, and an exhaust conduit 130 (see FIGS. 1, 2 and 4) respectively.

Figure 3:
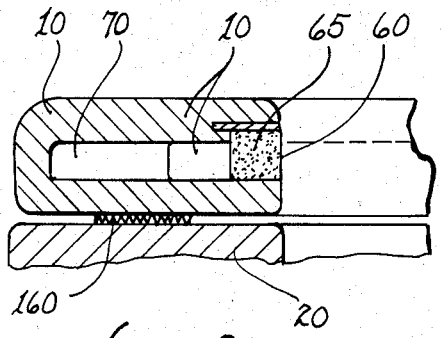
FIG. 3 is a cross sectional view taken along the line 3—3 of FIG. 1 in the direction of the arrows.

Referring to FIG. 3 of the accompanying drawings, the inlet port 60 is centrally located on a front inner surface of the toilet seat 10 which location has been determined to be the most effective to transfer air and odors out of a toilet bowl and the least attractive "target" for male users. Odorous air passes through the pre-filter element 65 and exits the inlet port 60 into the transfer duct 70 and then into the exhaust duct 90.

Figure 2:
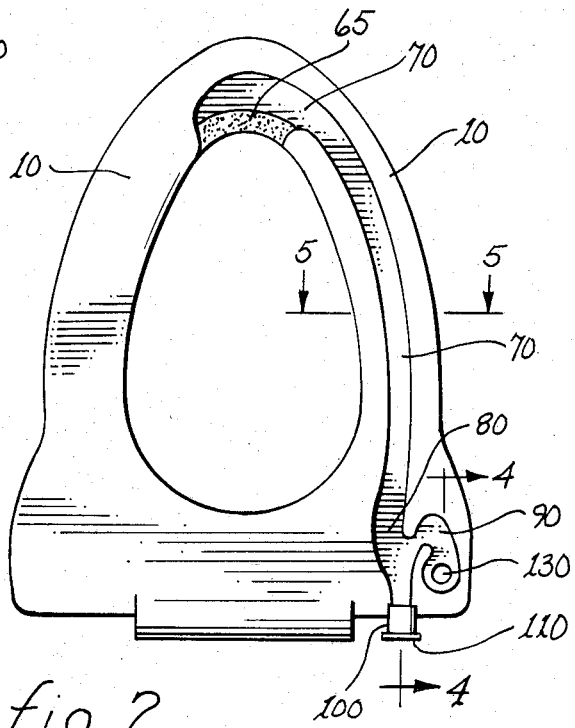
FIG. 2 is a horizontally cutaway view of the toilet seat of FIG. 1.

Referring now to accompanying FIG. 2, the inlet port 60, the transfer duct 70, a water bleed-off duct 80, and the exhaust duct 90 are all defined by a duct system located within the toilet seat 10.

The moisture laden and odorous air flows through transfer duct 70 until the air flow is directed into the exhaust duct 90 which is positioned at an oblique angle from the transfer duct 70 within the same horizontal plane. The bleed-off duct 80 is situated generally in a linear direction and cooperates with the transfer duct 70. The bleed-off duct 80 and begins at the point where the air flow is directed from the transfer duct 70 to the exhaust duct 90. As the moisture laden air is directed at the oblique angle into the exhaust duct 90, suspended particulates, specifically water droplets, which have a generally greater mass than the odorous air and therefore a higher level of kinetic energy, flow into the bleed-off duct 80 and not into the exhaust duct 90.

Further, when the toilet seat 10 is in an upright position, any moisture which may accumulate in the transfer duct 70 is gravitationally directed into the bleed-off duct 80 (and through hollow member 100) thereby minimizing the moisture level within the exhaust duct 90 and the remaining elements of the exhaust system.

Figure 4:
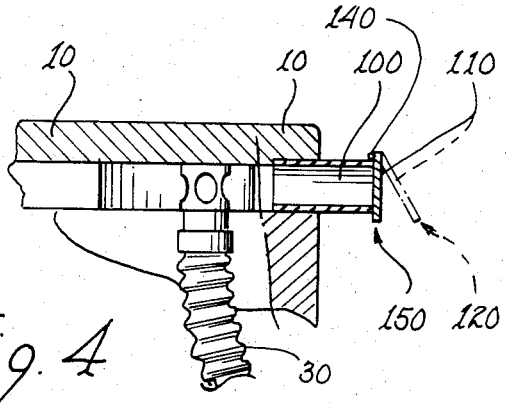
FIG. 4 is a cross sectional view taken along the line 4—4 of FIG. 2 in the direction of the arrows.

As shown in FIG. 4, a bleed-off cap 110 fits over a rear facing end of the hollow member 100 and is connected pivotally, at an upper end, thereto by a hinge means 140. When the toilet seat 10 is lowered into the use position, the bleed-off cap 110 is gravitationally positioned against the rear facing end of the hollow member 100, as shown by reference number 150, thereby containing any accumulated vapors therein. When the toilet seat 10 is raised into the non-use position, the bleed-off cap 110 is gravitationally positioned away from the rear facing end of the hollow member 100, as suggested by reference number 120, thereby allowing any moisture accumulation to drain out of the hollow member 100 into a receptacle (not shown).

The described upstream water bleed-off means allows the exhaust duct 90, the exhaust conduit 130, the exhaust tubular member 30, and the air extractor 40, to remain relatively moisture-free, and consequently the expected life of the inventive toilet ventilation system is prolonged.

The exhaust conduit 130 is sealed at the uppermost end by the upper boundary of the exhaust duct 90, and another end is operably connected to the exhaust tubular member 30. The exhaust tubular member 30 is in turn operably connected to the air extractor filter 170 and the air extractor system 40.

The electrically powered air extractor system comprises one of three systems: either a wall mounted extractor system, a central house vacuum system, or an extractor system which is located in relatively close proximity to the toilet fixture. Such an air extractor system could include Northland vacuum motor unit models 5510 or 5512, or other equivalent units.

In one embodiment, the electrically powered air extractor system forces the odorous air through a deodorizing and/or disinfectant means located within the prefilter 65 and/or the air extractor filter 170 for recirculation back into the inside environment.

In another embodiment, the odorous air is forced out of the bathroom and into the surrounding environment.

In another embodiment, the wall mounted extractor system is controlled by an ON/OFF switch located within easy and proximate reach of the user.

In still another embodiment, the extractor system which is located in relatively close proximity to the toilet fixture is controlled by an ON/OFF switch operably attached thereto.

While the invention has been particularly shown and described in reference to the preferred embodiments thereof, it will be understood by those skilled in the art that changes in form and details may be made without departing from the spirit and scope of the invention.

We claim:

1. A toilet ventilation system comprising:

(a) a toilet seat removably and pivotally attachable to a toilet; said toilet having a conventional toilet bowl rim;

(b) a duct means formed within said toilet seat for providing an inlet exhaust interface extending to an interior portion of said toilet;

(c) an air extraction means coupled to said duct means and cooperating with said inlet exhaust interface for permitting the exhausting of noxious odors away from said interior of said toilet; and (d) a water bleed-off means coupled to said duct means for removing water inadvertently accumulated in said duct means into an external small receptacle placed directly beneath said water bleed-off means.

2. A toilet ventilation system in accordance with claim 1, wherein:

said duct means includes an inlet port, an exit port, and an elongated curved duct coupled to said inlet and exit ports, said inlet port being centrally and frontally positioned on a lower inside portion near a bottom of said toilet seat, and a removable porous pre-filter element located in said inlet port.

3. A toilet ventilation system in accordance with claim 1, wherein:

said water bleed-off means is located near one end of said duct means and includes a hollow member, a first end of said hollow member being coupled to said duct means near one end thereof and a cap means pivotally connected to said hollow member at a second end thereof for permitting by gravity actuation the removal of said inadvertently accumulated water in said duct means into an external, small receptacle placed directly beneath said water bleed-off means when said toilet seat is in a raised vertical position relative to said bowl rim of said toilet.

4. A toilet ventilation system in accordance with claim 3, wherein:

said air extraction means includes a vertically oriented exhaust fitting extending from a bottom portion of said toilet seat to an upper surface of said duct means, an exhaust tubular means coupled to said exhaust fitting, and a vacuum means coupled to said exhaust tubular means for creating a differential air pressure to exhaust said noxious odors within said exhaust tubular means, said exhaust fitting, said duct means, and said interior of said toilet, said differential air pressure simultaneouly closing said pivotally connected cap means whenever said toilet seat is in a horizontal position.

5. A toilet ventilation system in accordance with claim 4, wherein:

said air extraction means is electrically powered and is located adjacent to said toilet.

6. A toilet ventilation system in accordance with claim 2, wherein:

said pre-filter element provides a scenting means for deodorizing said noxious odors passing therethrough.

7. A toilet ventilation system in accordance with claim 2, further including a gasket means for operably sealing said toilet seat to said bowl rim of said toilet.

8. A toilet ventilation system comprising:

(a) a toilet seat removably and pivotally attachable to a toilet, said toilet having a conventional toilet bowl rim;

(b) a duct means formed within said toilet seat for providing an inlet exhaust interface extending to an interior portion of said toilet, said duct means including an inlet port, an exit port, and an elongated curved duct coupled to said inlet and exit ports, said inlet port being centrally and frontally positioned on a lower inside portion near a bottom of said toilet seat, and a removable porous pre-filter element located in said inlet port, said pre-filter element having a scenting means for deodorizing noxious odors passing therethrough, said toilet seat including a gasket means for operably sealing said toilet seat to said bowl rim of said toilet;

(c) an air extraction means coupled to said duct means and cooperating with said inlet exhaust interface for permitting the exhausting of said noxious odors away from said interior of said toilet, said air extraction means including a vertically oriented exhaust fitting extending from a bottom portion of said toilet seat to an upper surface of said duct means, an exhaust tubular means coupled to said exhaust fitting, and a vacuum means coupled to said exhaust tubular means for creating a differential air pressure to exhaust said noxious odors within said exhaust tubular means, said exhaust fitting, said duct means, and said interior of said toilet, said air extraction means is electrically powered and is located adjacent to said toilet; and (d) a water bleed-off means coupled to said duct means for removing water inadvertently accumulated in said duct means into an external small receptacle placed directly beneath said water bleed-off means, said water bleed-off means being located near one end of said duct means and includes a hollow member, a first end of said hollow member being coupled to said duct means near one end thereof and a cap means pivotally connected to said hollow member at a second end thereof for permitting by gravity actuation the removal of said inadvertently accumulated water in said duct means when said toilet seat is in a raised vertical position relative to said bowl rim of said toilet, additionally, said differential air pressure simultaneously closing said pivotally connected cap means whenever said toilet is lowered to a horizontal position.

9. A method for venting noxious odors from a toilet comprising the steps of:

(a) providing a toilet seat having duct means for providing an inlet exhaust interface extending to an interior portion of said toilet, said toilet having a conventional toilet bowl rim;

(b) providing an air extraction means coupled to said duct means and cooperating with said inlet exhaust interface for permitting the exhausting of noxious odors away from said interior of said toilet; and (c) providing a water bleed-off means coupled to said duct means for removing water inadvertently accumulated in said duct means into an external, small receptacle placed directly beneath said water bleed-off means.

10. A method in accordance with claim 9, wherein: said water bleed-off means is located near one end of said duct means and includes a hollow member, a first end of said hollow member being coupled to said duct means near one end thereof and a cap means pivotally connected to said hollow member at a second end thereof for permitting by gravity actuation the removal of said inadvertently accumulated water in said duct means into a receptacle placed directly beneath said water bleed-off means when said toilet seat is in a raised vertical position relative to said bowl rim of said toilet.

11. A method in accordance with claim 9, wherein said duct means includes an inlet port, an exit port, and an elongated curved duct coupled to said inlet and exit ports, said inlet port being centrally and frontally positioned on an inside portion near a bottom of said toilet seat, and a removable porous pre-filter element located in said inlet port.

12. A method in accordance with claim 10 wherein said air extraction means includes a vertically oriented exhaust fitting extending from a bottom portion of said toilet seat to an upper surface of said duct means, an exhaust tubular means coupled said exhaust fitting, and a vacuum means coupled to said exhaust tubular means for creating a differential air pressure to exhaust said noxious odors in said exhaust tubular means, said exhaust fitting, said duct means, and said interior of said toilet, said differential air pressure simultaneously closing said pivotally connected cup means whenever said toilet seat is in a horizontal position.

* * * * *